US007086244B2

(12) United States Patent
Yamasaki et al.

(10) Patent No.: US 7,086,244 B2
(45) Date of Patent: Aug. 8, 2006

(54) REFRIGERANT CYCLE APPARATUS

(75) Inventors: Haruhisa Yamasaki, Gunma (JP); Kenzo Matsumoto, Gunma (JP); Shigeya Ishigaki, Gunma (JP); Masaji Yamanaka, Gunma (JP); Kentaro Yamaguchi, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/859,194

(22) Filed: Jun. 3, 2004

(65) Prior Publication Data

US 2005/0072173 A1 Apr. 7, 2005

(30) Foreign Application Priority Data

Jun. 10, 2003 (JP) ..... 2003-165205

(51) Int. Cl.
*F25B 41/04* (2006.01)
*F25B 49/02* (2006.01)

(52) U.S. Cl. ..... 62/196.2; 62/228.5

(58) Field of Classification Search ..... 62/196.1, 62/196.2, 196.3, 510, 228.5; 236/1 EA
See application file for complete search history.

(56) References Cited

U.S. PATENT DOCUMENTS 3,495,418 A * 2/1970 Kapich ..... 62/228.5
4,026,122 A 5/1977 Kuhn et al.
4,362,030 A * 12/1982 Voorhis ..... 62/510
5,396,779 A * 3/1995 Voss ..... 62/196.2
5,577,390 A * 11/1996 Kaido et al. ..... 62/228.5
6,732,542 B1 * 5/2004 Yamasaki et al. ..... 62/510
2002/0178741 A1 12/2002 Chumley et al.

FOREIGN PATENT DOCUMENTS

EP 0 538 179 A1 4/1993
EP 1 120 612 A1 8/2001
EP 1 312 880 A2 5/2003
EP 1 316 730 A2 6/2003
WO WO 02/01330 A 1/2002
WO WO 03/004948 A 1/2003

OTHER PUBLICATIONS

Patent Abstracts of Japan, 07301461, Nov. 1995, Europe.
Patent Abstracts of Japan, 2003074997, Mar. 2003, Europe.
Patent Abstracts of Japan, 2000146328, May 2000, Europe.

* cited by examiner

*Primary Examiner*—Harry B. Tanner
(74) *Attorney, Agent, or Firm*—Westerman, Hattori, Daniels & Adrian, LLP.

(57) ABSTRACT

An object of the present invention is to provide a refrigerant cycle apparatus which can reduce a production cost while hastening equalization of pressure in a refrigerant circuit after a compressor is stopped, the apparatus comprises a bypass circuit which causes an intermediate-pressure area to communicate with a low-pressure side of a refrigerant circuit, a valve device provided to this bypass circuit and a control device which controls opening/closing of this valve device, and the control device constantly closes the valve device but opens it in order to release a flow path of the bypass circuit concurrently with the stop of the compressor.

5 Claims, 5 Drawing Sheets

REFRIGERANT CYCLE APPARATUS

BACKGROUND OF THE INVENTION

The present invention relates to a refrigerant cycle in which a refrigerant circuit is constituted by sequentially connecting a compressor, a gas cooler, throttling means and an evaporator.

In this type of conventional refrigerant cycle apparatus, a refrigerant cycle (refrigerant circuit) is constituted by sequentially annularly pipe-connecting a compressor, e.g., a multistage compression type rotary compressor having an internal intermediate pressure, a gas cooler, throttling means (expansion valve or the like), an evaporator and others. Further, a refrigerant gas is taken into a low-pressure chamber side of a cylinder from an intake port of a rotary compression element of the rotary compressor, and compression is performed by operations of a roller and a vane, thereby obtaining a refrigerant gas having a high temperature and a high pressure. This refrigerant gas is discharged from a high-pressure chamber side to a gas cooler through a discharge port and a discharge sound absorbing chamber. The refrigerant gas releases its heat in the gas cooler, and is then throttled by the throttling means and supplied to the evaporator. The refrigerant is evaporated there and endotherm is performed from the circumference at this time, thereby demonstrating a cooling effect.

Here, in order to cope with the global environmental problems in recent years, there has been developed an apparatus using a transcritical refrigerant cycle which utilizes carbon dioxide ($CO_2$) being a natural refrigerant as a refrigerant in place of conventional fluorocarbon and operates with a high-pressure side being used as a supercritical pressure.

In such a refrigerant cycle apparatus, in order to prevent a liquid refrigerant from returning into the compressor which results in liquid compression, an accumulator is arranged on a low-pressure side between an outlet side of the evaporator and an intake side of the compressor, the liquid refrigerant is stored in this accumulator, and only the gas is taken into the compressor. Furthermore, throttling means is adjusted so as to prevent the liquid refrigerant in the accumulator from returning into the compressor (see, e.g., Japanese Patent Application Laid-open No. 7-18602).

However, providing the accumulator on the low-pressure side of the refrigerant cycle requires a large refrigerant filling quantity. Moreover, an opening of the throttling means must be reduced or a capacity of the accumulator must be increased in order to avoid the return of the liquid, which leads to a reduction in cooling capability or an increase in installation space. Thus, in order to solve the liquid compression in the compressor without providing the accumulator, an applicant attempted a development of a refrigerant cycle apparatus depicted in a prior art drawing of FIG. 3.

In FIG. 3, reference numeral 10 denotes an internal intermediate-pressure multistage compression type rotary compressor, and this compressor comprises an electric element 14 in a sealed container 12, and a first rotary compression element 32 and a second rotary compression element 34 which are driven by a rotary shaft 16 of this electric element 14.

An operation of the refrigerant cycle apparatus in this example will now be described. A refrigerant with a low pressure sucked from a refrigerant introducing tube 94 of the compressor 10 is compressed to have an intermediate pressure by the first rotary compression element 32, and discharged into the sealed container 12. Thereafter, it flows out from the refrigerant introducing tube 92 and enters an intermediate cooling circuit 150A. The intermediate cooling circuit 150A is provided so as to run through a gas cooler 154, and heat of the refrigerant is released there by an air-cooling method. Here, heat of the refrigerant having an intermediate pressure is taken by the gas cooler.

Thereafter, the refrigerant is taken into the second rotary compression element 34 where the second compression is performed, and the refrigerant is turned into a refrigerant gas with a high temperature and a high pressure and discharged to the outside by a refrigerant discharge pipe 96. At this moment, the refrigerant is compressed to an appropriate supercritical pressure.

The refrigerant gas discharged from the refrigerant discharge tube 96 flows into the gas cooler 154 where heat of the refrigerant gas is released by the air-cooling method, and it passes through an internal heat exchanger 160. Heat of the refrigerant is taken by the refrigerant on a low-pressure side which has flowed out from an evaporator 157, and the former refrigerant is further cooled. Then, the refrigerant is reduced in pressure by an expansion valve 156 and enters a gas/liquid mixed state in this process. Then, it flows into the evaporator 157 and evaporates. The refrigerant which has flowed from the evaporator 157 passes through the internal heat exchanger 160, and it takes heat from the refrigerant on the high-pressure side, thereby further being heated.

Then, the refrigerant heated in the internal heat exchanger 160 repeats the cycle in which it is sucked into the first rotary compression element 32 of the compressor 10 from the refrigerant introducing tube 94. In this manner, a degree of superheat can be taken by heating the refrigerant which has flowed out from the evaporator 157 with the refrigerant on the high-pressure side by the internal heat exchanger 160, the return of the liquid that the liquid refrigerant is sucked into the compressor 10 can be prevented without provided an accumulator or the like on the low-pressure side, and an inconvenience that the compressor 10 is damaged by the liquid compression can be avoided.

In such a refrigerant cycle apparatus, when the compressor 10 is stopped, the refrigerant with a high pressure flows into the sealed container 12 from a gap of the cylinder 38, and a high pressure and an intermediate pressure reach an equilibrium pressure and then reach the equilibrium pressure together with a low pressure. Therefore, it takes a considerable time for the pressures in the refrigerant circuit to become an equalized pressure.

In this case, if there is a difference between a high pressure and a low pressure of the rotary compression elements at the time of restart after the stop, the startability is deteriorated and a damage may be possibly generated.

Additionally, since the intermediate pressure in the sealed container first reaches the equilibrium pressure together with the pressure on the high-pressure side, the pressure is increased after stopping the normal operation. Therefore, the pressure proof design of the sealed container of the compressor must be carried out taking an increase in pressure after the stop into consideration, which results in an increase in production cost.

SUMMARY OF THE INVENTION

In order to eliminate the above-described technical problems, it is an object of the present invention to provide a refrigerant cycle apparatus which can reduce a production cost while hastening equalization of pressures in a refrigerant circuit after stopping a compressor.

That is, a refrigerant cycle apparatus according to the present invention comprises: a bypass circuit which causes an intermediate-pressure area to communicate with a low-pressure side in a refrigerant circuit or causes a high-pressure side to communicate with the intermediate-pressure area in the same; a valve device provided to this bypass circuit; and a control device which controls opening/closing of this valve device, wherein the control device constantly closes the valve device but opens it in order to open a flow path of the bypass circuit when a compressor is stopped, thereby hastening equalization of pressures in the refrigerant circuit after stopping the compressor.

Further, in addition to the above-described invention, the present invention is characterized in that the valve device is opened concurrently with the stop of the compressor.

Furthermore, in addition to the above-described invention, the present invention is characterized in that the valve device is opened in a period immediately before the stop of the compressor and after the stop of the same.

Moreover, in addition to the above-described invention, the present invention is characterized in that the valve device is opened after a predetermined period from the stop of the compressor.

Additionally, in addition to each of the above-described inventions, the present invention is characterized in that carbon dioxide is used as a refrigerant.

BRIEF DESCRIPTION OF THE DRAWINGS

FIGS. 2-1 and 2-2 schematically illustrate a refrigerant circuit diagram of an alternate embodiment of the refrigerant cycle apparatus according to the present invention.

DETAILED DESCRIPTION OF THE PREFERRED EMBODIMENT

Figure 1:
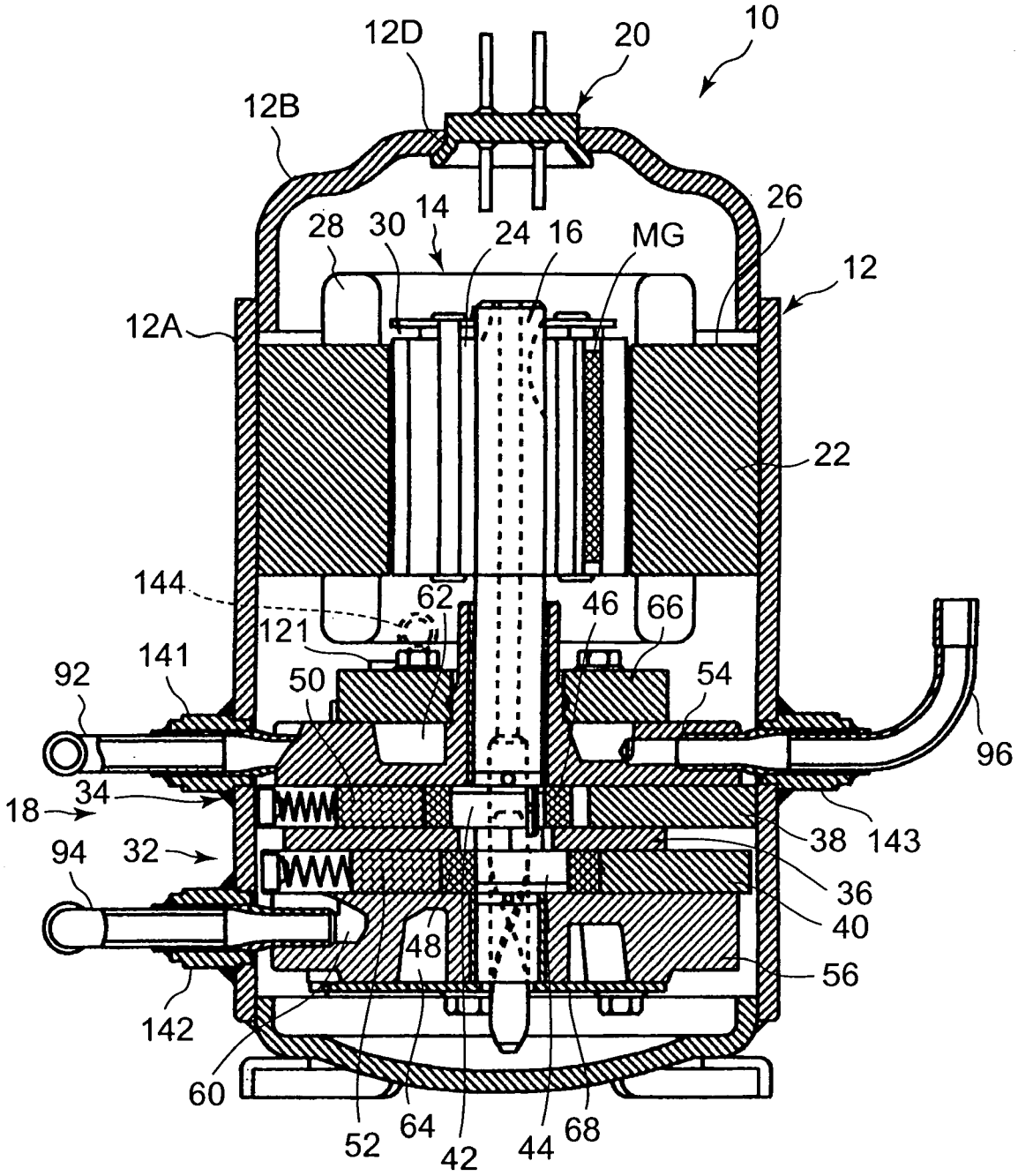
FIG. 1 is a vertical cross-sectional view showing an internal intermediate-pressure multistage compression type rotary compressor of an embodiment used in a refrigerant cycle apparatus according to the present invention.
Figure 2:
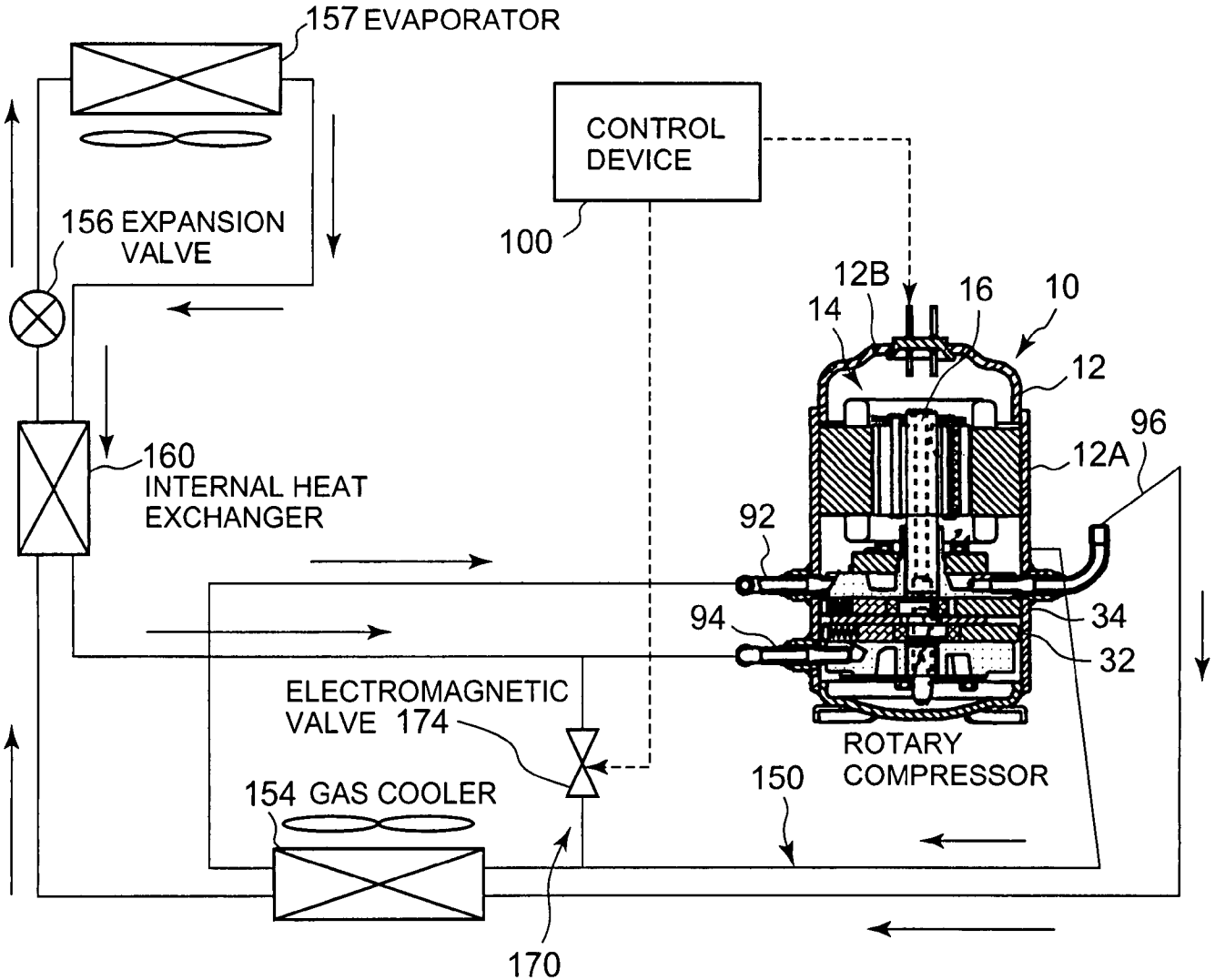
FIG. 2 is a refrigerant circuit diagram of the refrigerant cycle apparatus according to the present invention.
Figures 1, 2:
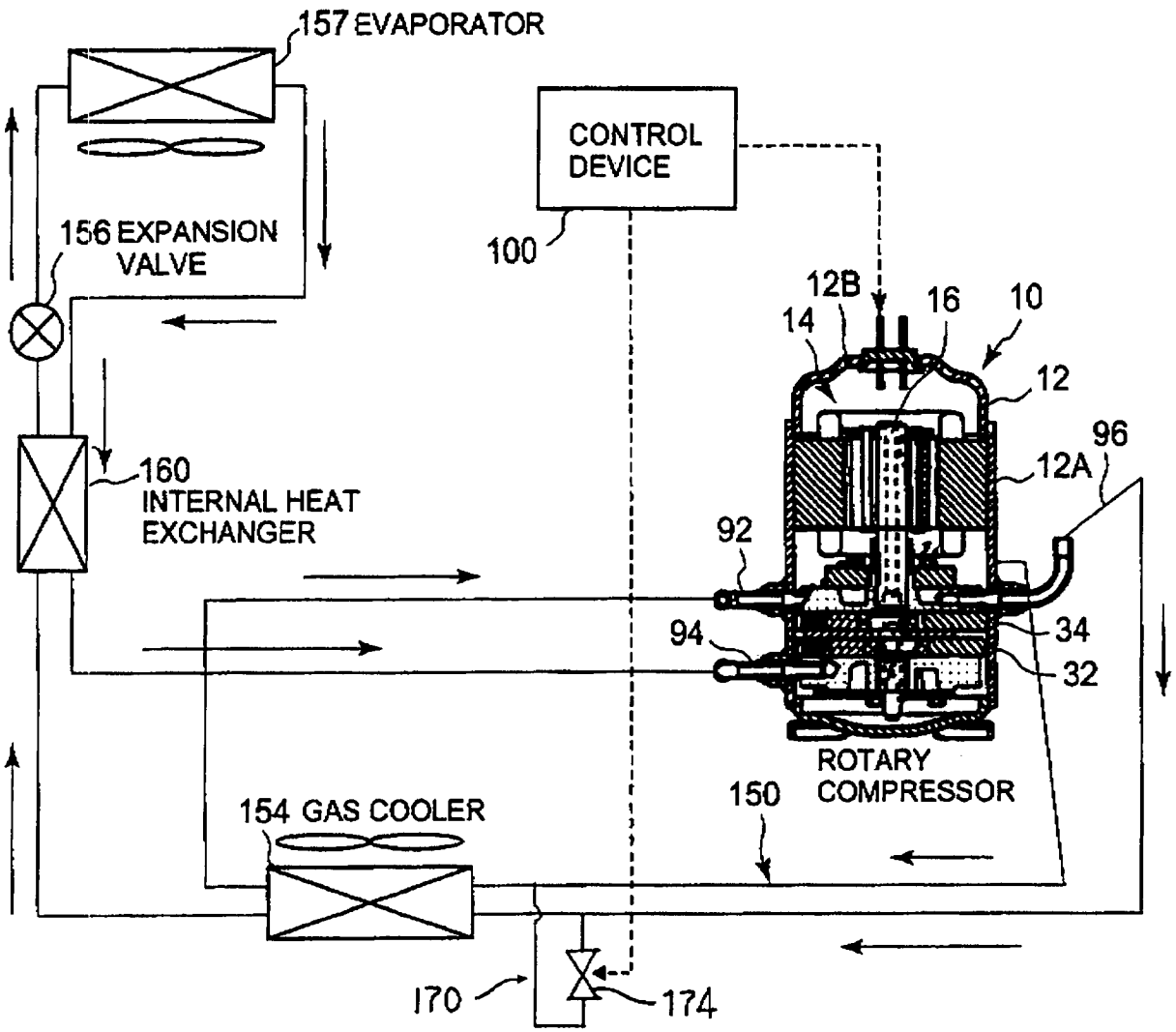
Figure 2:
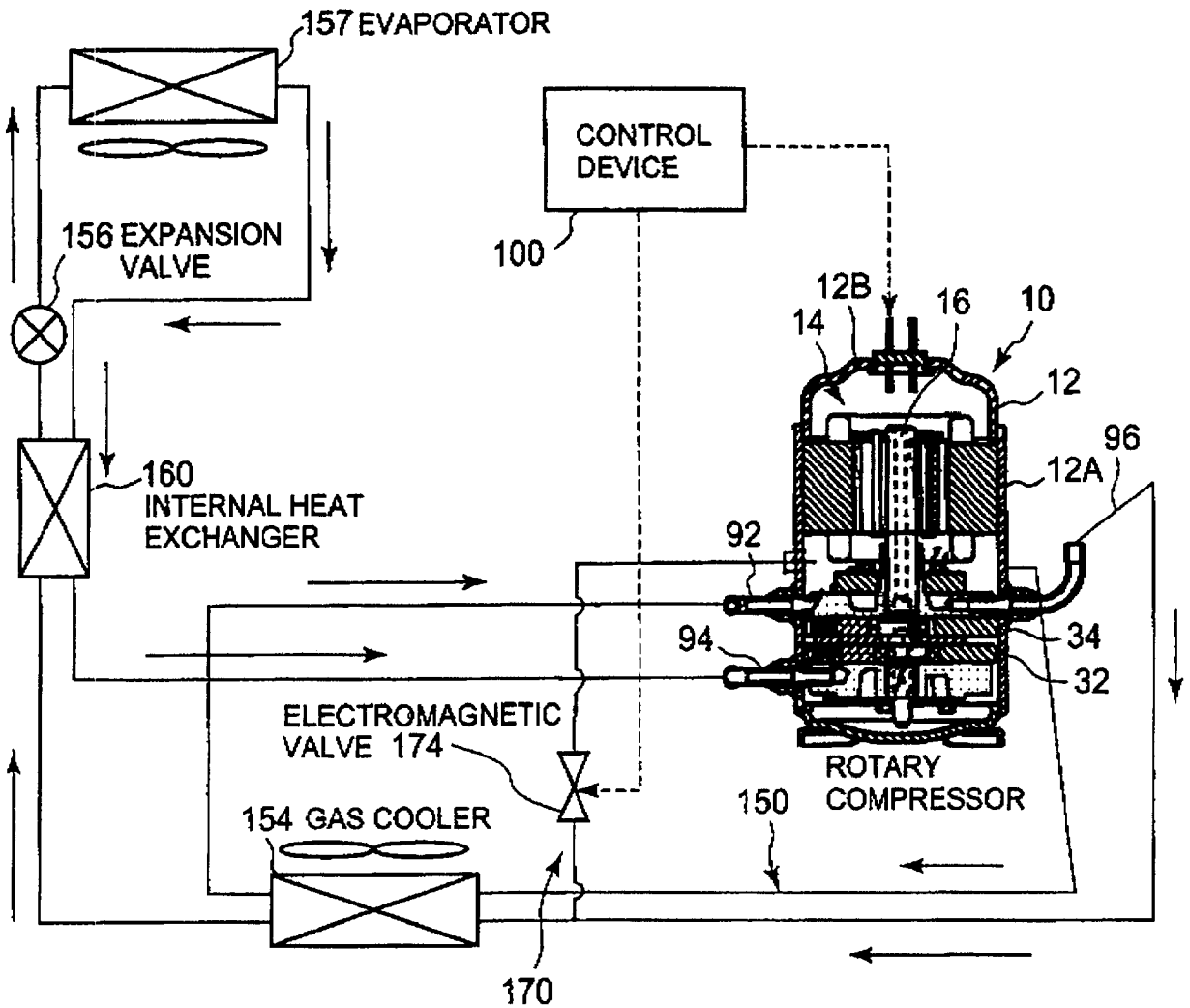
Figure 3:
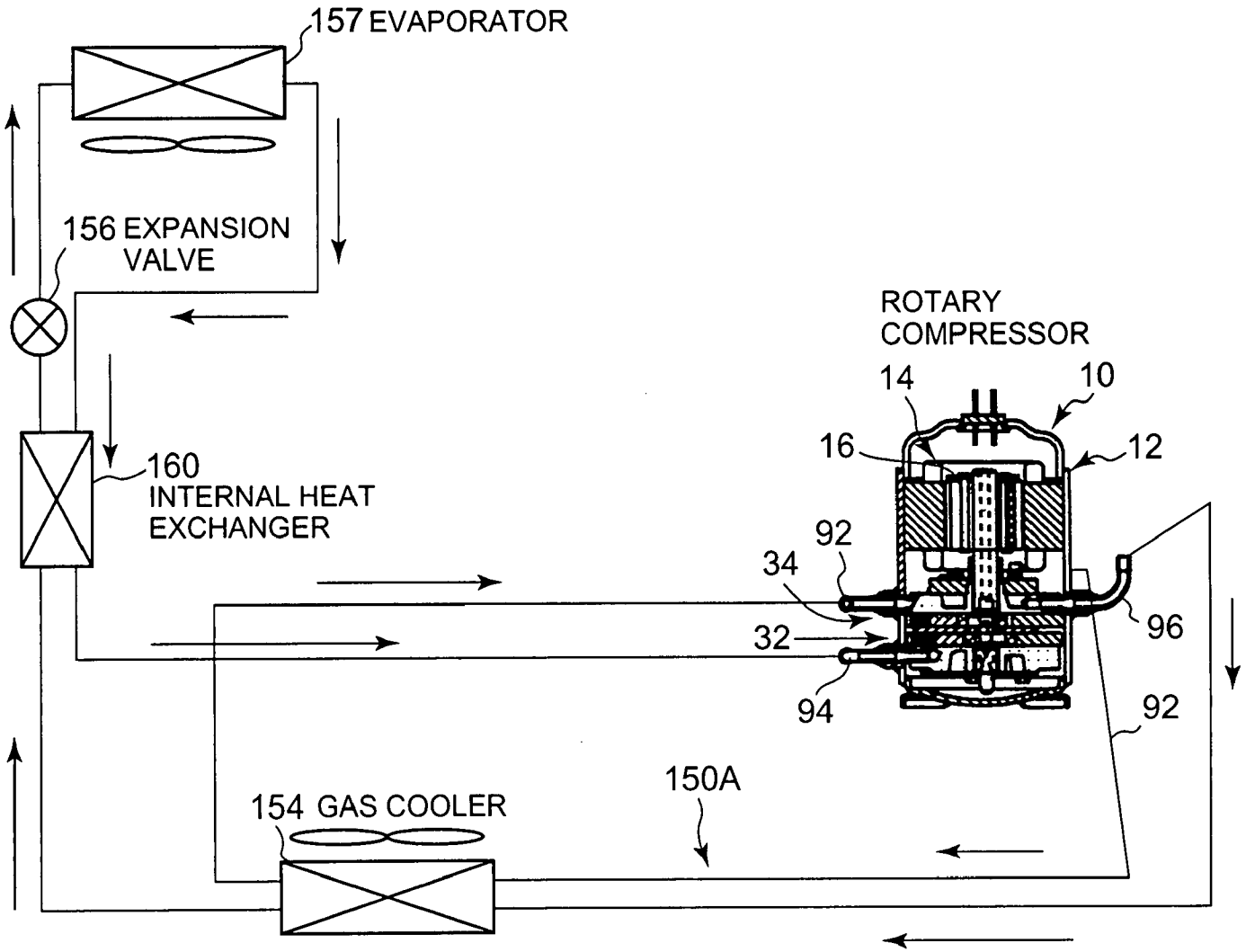
FIG. 3 is a refrigerant circuit diagram of a conventional refrigerant cycle apparatus.

A preferred embodiment according to the present invention will now be described with reference to the accompanying drawings. FIG. 1 is a vertical cross-sectional view of an internal intermediate-pressure multistage (two-stage) compression type rotary compressor 10 comprising a first rotary compression element (first compression element) 32 and a second rotary compression element (second compression element) 34 as an embodiment of a compressor used in a refrigerant cycle apparatus according to the present invention, and FIG. 2 is a refrigerant circuit diagram of the refrigerant cycle apparatus according to the present invention.

In each drawing, reference numeral 10 denotes an internal intermediate-pressure multistage compression type rotary compressor which uses carbon dioxide ($CO_2$) as a refrigerant, and this compressor 10 is constituted of a cylindrical sealed container 12 formed of a steel plate, an electric element 14 as a drive element which is arranged and accommodated on an upper side in an internal space of this sealed container 12, and a rotary compression mechanism portion 18 which is arranged on a lower side of this electric element 14 and is composed of a first rotary compression element 32 (first stage) and a second rotary compression element 34 (second stage) which are driven by a rotary shaft 16 of the electric element 14. It is to be noted that the electric element 14 of the compressor 10 is a so-called pole concentrated winding type DC motor, and the number of revolutions and a torque are controlled by an inverter.

A bottom portion of the sealed container 12 is an oil reservoir, and the sealed container 12 is constituted of a container main body 12A which accommodates the electric element 14 and the rotary compression mechanism portion 18 and a bowl-like end cap (cap body) 12B which closes an upper opening of the container main body 12A. Further, a circular attachment hole 12D is formed at a center of an upper surface of the end cap 12B, and a terminal (wiring is eliminated) 20 used to supply a power to the electric element 14 is attached to this attachment hole 12D.

The electric element 14 comprises a stator 22 which is attached in an annular form along an inner peripheral surface of an upper space of the sealed container 12, and a rotor 24 which is inserted and provided in this stator 22 with a slight space therebetween. This rotor 24 is fixed to a rotary shaft 16 which extends through the center thereof in the perpendicular direction. The stator 22 has a lamination body 26 in which donut-like magnetic steel sheets are laminated, and a stator coil 28 wound around the lamination body 26 by a series winding (concentrated winding) method. Further, the rotor 24 is formed of a lamination body 30 of magnetic steel sheets like the stator 22, constituted by inserting a permanent magnet MG in this lamination body 30.

An intermediate partition plate 36 is held between the first rotary compression element 32 and the second rotary compression element 34. That is, the first rotary compression element 32 and the second rotary compression element 34 are constituted of the intermediate partition plate 36, upper and lower cylinders 38 and 40 which are arranged above and below this intermediate partition plate 36, upper and lower rollers 46 and 48 which are eccentrically rotated by upper and lower eccentric portions 42 and 44 provided to the rotary shaft 16 in the upper and lower cylinders 38 and 40 with a phase difference of 180 degrees, vanes 50 and 52 which are in contact with the upper and lower rollers 46 and 48 and compart the inside of each of the upper and lower cylinders 38 and 40 into a low-pressure chamber side and a high-pressure chamber side, and upper and lower support members 54 and 56 as support members which close an upper opening surface of the upper cylinder 38 and a lower opening surface of the lower cylinder 40 and also function as beatings of the rotary shaft 16.

On the other hand, to the upper support member 54 and the lower support member 56 are provided intake paths 60 (upper intake path is not shown) which communicate with the inside of each of the upper and lower cylinders 38 and 40 at non-illustrated intake ports, and discharge sound absorbing chambers 62 and 64 which are partially concaved and formed by closing the concave portions with an upper cover 66 and a lower cover 68.

It is to be noted that the discharge sound absorbing chamber 64 communicates with the inside of the sealed container 12 through a communication path which pierces the upper and lower cylinders 38 and 40 or the intermediate partition plate 36, an intermediate discharge tube 121 is provided so as to protrude at an upper end of the communication path, and a refrigerant gas with an intermediate pressure compressed by the first rotary compression element 32 is discharged into the sealed container 12 from the intermediate discharge tube 121.

Furthermore, as a refrigerant, the above-described carbon dioxide ($CO_2$) which is a natural refrigerant friendly to the global environment is used while taking the combustibility, the toxicity and others into consideration. As an oil which is a lubricating oil, there is used an existing oil such as mineral oil, alkylbenzene oil, ether oil, ester oil, PAG (polyalkyleneglycol) and the like. Sleeves 141, 142, 143 and 144 are respectively welded and fixed on a side surface of the container main body 12A of the sealed container 12 at positions corresponding to the intake paths 60 (upper path is not illustrated) of the upper support member 54 and the lower support member 56, the discharge sound absorbing chamber 62 and an upper side of the upper cover 66 (position substantially corresponding to the lower end of the electric element 14). Moreover, one end of a refrigerant introducing tube 92 which is used to introduce a refrigerant gas into the upper cylinder 38 is inserted into and connected with the sleeve 141, and this end of the refrigerant introducing tube 92 communicates with the non-illustrated intake path of the upper cylinder 38. This refrigerant introducing tube 92 reaches the sleeve 144 through a gas cooler 154 provided to a later-described intermediate cooling circuit 150, and the other end of the same is inserted into and connected with the sleeve 144 and thereby communicates with the inside of the sealed container 12.

Additionally, one end of a refrigerant introducing tube 94 which is used to introduce the refrigerant gas into the lower cylinder 40 is inserted into and connected with the sleeve 142, and this end of the refrigerant introducing tube 94 communicates with the intake path 60 of the lower cylinder 40. Further, a refrigerant discharge tube 96 is inserted into and connected with the sleeve 143, and this end of the refrigerant discharge tube 96 communicates with the discharge sound absorbing chamber 62.

In FIG. 2, the above-described compressor 10 constitutes a part of the refrigerant circuit depicted in FIG. 2. That is, the refrigerant discharge tube 96 of the compressor 10 is connected with an inlet of the gas cooler 154. Furthermore, the tube connected with an outlet of the gas cooler 154 runs through an internal heat exchanger 160. This internal heat exchanger 160 is used to exchange heat of the refrigerant on the high-pressure side which has flowed out from the gas cooler 154 with heat of the refrigerant on the low-pressure side which has flowed out from an evaporator 157.

The tube running through the internal heat exchanger 160 reaches an expansion valve 156 as throttling means. Furthermore, an outlet of the expansion valve 156 is connected with an inlet of an evaporator 157, and the tube running from the evaporator 157 is connected with the refrigerant introducing tube 94 through the internal heat exchanger 160.

Moreover, a bypass circuit 170 which causes an intermediate-pressure area to communicate with a lower-pressure side in the present invention is provided to the refrigerant circuit. That is, a bypass circuit 170 diverges from a middle part of the refrigerant introducing tube 92 of the intermediate cooling circuit 150 which is the intermediate-pressure area (not shown in FIG. 1). Additionally, the bypass circuit 170 is connected with the refrigerant introducing tube 94 which corresponds to the low-pressure side in the refrigerant circuit. An electromagnetic valve 174 as a valve device which is used to open/close a flow path of the bypass circuit 170 is provided to this bypass circuit 170, and opening/closing of this electromagnetic valve 174 is controlled by a control device 100.

Here, the control device 100 is a control device which controls the refrigerant circuit, and it controls opening/closing of the electromagnetic valve 174, throttle adjustment of the expansion valve 156 and the number of revolutions of the compressor 10. The control device 100 constantly closes the electromagnetic valve 174, but opens it in order to release the flow path of the bypass circuit 170 when the compression 10 is stopped. That is, in this embodiment, the control device 100 closes the electromagnetic valve 174 during the operation of the compressor 10, and opens the electromagnetic valve 174 concurrently with the stop of the compressor 10, thereby releasing the flow path of the bypass circuit 170.

It is to be noted that the intermediate-pressure area corresponds to all the paths required for the refrigerant compressed by the first rotary compression element 32 to be sucked into the second rotary compression element 34, and the bypass circuit 170 is not restricted to a position in the embodiment. A connection position of the bypass circuit 170 is not restricted to a particular position as long as it causes a path through which the refrigerant gas with an intermediate pressure passes to communicate with a path through which the refrigerant gas with a low pressure passes.

A description will now be given as to an operation of the refrigerant cycle apparatus according to the present invention with the above-described structure. It is to be noted that the electromagnetic valve 174 of the bypass circuit 170 is opened by the control device 100 before activating the compressor 10. When the stator coil 28 of the electric element 14 of the compressor 10 is energized by the control device 100 through the terminal 20 and a non-illustrated wiring, the control device 100 closes the electromagnetic valve 174 and activates the electric element 14 by using the inverter.

As a result, the rotor 24 starts rotation, and the upper and lower rollers 46 and 48 fitted with the upper and lower eccentric portions 42 and 44 which are integrally provided with the rotary shaft 16 eccentrically rotate in the upper and lower cylinders 38 and 40. Then, a refrigerant gas with a low pressure (approximately 4 MPa in a normal operation state) sucked to the low-pressure chamber side of the cylinder 40 from a non-illustrated intake port through the refrigerant introducing tube 94 and the intake path 60 formed to the lower support member 56 is compressed by the operations of the roller 48 and the vane 52 so as to have an intermediate pressure (approximately 8 MPa in the normal operation state), and discharged into the sealed container 12 from the intermediate discharge tube 121 from the high-pressure chamber side of the lower cylinder 40 through a non-illustrated communication path.

Further, the refrigerant gas with the intermediate pressure in the sealed container 12 enters the refrigerant introducing tube 92, flows out from the sleeve 144, and flows into the intermediate cooling circuit 150. Here, since the electromagnetic valve 174 is closed by the control device 100 during the operation of the compressor 10, the refrigerant gas with the intermediate pressure which has flowed out from the sleeve 144 and flowed into the intermediate cooling circuit 150 all passes through the gas cooler 154. Then, the refrigerant gas which has flowed into the intermediate cooling circuit 150 releases its heat by the air-cooling method in a process of passing through the gas cooler 154. Since the refrigerant gas with the intermediate pressure compressed by the first rotary compression element 32 can be effectively cooled in the gas cooler 154 by causing this refrigerant gas to pass through the intermediate cooling circuit 150 in this manner, an increase in temperature in the sealed container 12 can be suppressed, and the compression efficiency in the second rotary compression element 34 can be improved.

The refrigerant gas with the intermediate pressure cooled in the gas cooler 154 is sucked to the low-pressure chamber side of the upper cylinder 38 of the second rotary compression element 34 from a non-illustrated intake port through a non-illustrated intake path formed to the upper support member 54.

The refrigerant gas sucked to the low-pressure chamber side of the upper cylinder 38 of the second rotary compression element 34 is subjected to the second compression by the operations of the roller 46 and the vane 50, turned into a refrigerant gas with a high temperature and a high pressure (approximately 12 MPa in a normal operation state), passes through a non-illustrated discharge port from the high-pressure chamber side, and is discharged to the outside from the refrigerant discharge tube 96 through the discharge sound absorbing chamber 62 formed to the upper support member 54. At this time, the refrigerant is compressed to an appropriate supercritical pressure, and the refrigerant gas discharged from the refrigerant discharge tube 96 flows into the gas cooler 154.

The refrigerant gas which has flowed into the gas cooler 154 releases its heat by the air-cooling method, and then passes through the internal heat exchanger 160. Heat of the refrigerant is taken by the refrigerant on the low-pressure side, and the former refrigerant is further cooled. As a result, the cooling capability of the refrigerant in the evaporator 157 is further improved by the advantage that a supercooling degree of the refrigerant is increased.

The refrigerant gas on the high-pressure side cooled in the internal heat exchanger 160 reaches the expansion valve 156. It is to be noted that the refrigerant gas is still in a gas state at the inlet of the expansion valve 156. The refrigerant is turned into a two-phase mixture formed of a gas and a liquid by a reduction in pressure in the expansion valve 156, and flows into the evaporator 157 in this state. The refrigerant is evaporated there, and endothermic is performed from air, thereby demonstrating the cooling effect.

Thereafter, the refrigerant flows out from the evaporator 157, and passes through the internal heat exchanger 160. The refrigerant takes heat from the refrigerant on the high-pressure side and undergoes the heating effect there. The refrigerant which has been evaporated to have a low temperature in the evaporator 157 and flowed out from the evaporator 157 may enter a state in which the gas and the liquid are mixed in place of the complete gas state in some cases, but a degree of superheat is eliminated and the refrigerant completely becomes the gas by causing it to pass through the internal heat exchanger 160 and exchange heat with the refrigerant on the high-pressure side. As a result, the return of the liquid that the liquid refrigerant is sucked into the compressor 10 can be assuredly prevented without providing an accumulator on the low-pressure side, and an inconvenience that the compressor 10 is damaged by the liquid compression can be avoided.

It is to be noted that the refrigerant heated by the internal heat exchanger 160 repeats a cycle in which the refrigerant is sucked into the first rotary compression element 32 of the compressor 10 from the refrigerant introducing tube 94.

An operation when the compressor 10 is stopped will now be described. The control device 100 stops the operation of the compressor 10 when, e.g., the evaporator 157 is covered with frost and, at the same time, it opens the electromagnetic valve 174 provided to the bypass circuit 170 in order to release the flow path of the bypass circuit 170. As a result, the intermediate-pressure area and the low-pressure side of the refrigerant circuit are caused to communicate with each other.

That is, when the operation of the compressor 10 is stopped, the refrigerant gas with a high-pressure flows from a gap of the cylinder 38, an intermediate pressure in the sealed container 12 is increased as will be described later, and the intermediate-pressure area and the high-pressure side reach an equilibrium pressure. Then, the low-pressure side has the equilibrium pressure together with the intermediate-pressure area and the high-pressure side, and pressures in the refrigerant circuit are equalized. If it takes a considerable time until the pressures in the refrigerant circuit are equalized and there is a difference in pressure of the rotary compression elements at the time of restart after the stop, the startability is deteriorated.

Moreover, if restart is performed with a difference in pressure in this manner, reversal of the intermediate pressure and the high pressure or an abnormal increase in pressure on the high-pressure side is apt to occur, which may results in a damage to the device.

Thus, in the present invention, the electromagnetic valve 174 is opened in order to release the bypass circuit 170 when the compressor 10 is stopped, and the intermediate-pressure area and the low-pressure side are caused to communicate with each other. Therefore, equalization of pressure in the intermediate-pressure area and the low-pressure side can be hastened.

As a result, a time required until the inside of the refrigerant circuit reaches an equalized pressure can be greatly shortened, and the startability at the time of restart after the stop can be improved.

Additionally, since the intermediate pressure and the pressure on the high-pressure side in the sealed container 12 first reach the equilibrium pressure in the prior art as described above, the pressure after stopping the compressor 10 becomes higher than that during the operation of the compressor 10. Therefore, the pressure proof design of the sealed container 12 must be carried out while taking an increase in pressure after the stop into consideration. However, in the present invention, by causing the intermediate-pressure area to communicate with the low-pressure side after stopping the compressor 10, the pressure in the sealed container 12 of the compressor 10 does not become higher than the pressure during the operation, thereby suppressing a design pressure of the sealed container 12.

Consequently, a wall thickness of the sealed container 12 can be reduced, and hence a manufacturing cost of the compressor 10 can be decreased.

On the other hand, when the compressor 10 is reactivated by the control device 100, the control device 100 fully closes the electromagnetic valve 174. As a result, the bypass circuit 170 is closed, and the refrigerant gas with the intermediate pressure compressed by the first rotary compression element 32 is all sucked into the second rotary compression element 34.

It is to be noted that the bypass circuit 170 which causes the intermediate-pressure area to communicate with the low-pressure side is provided to the refrigerant circuit in this embodiment, but the present invention is not restricted thereto, and the bypass circuit may cause the high-pressure side to communicate with the intermediate-pressure area of the refrigerant circuit (as illustrated in FIGS. 2-1 and 2-2). In this case, equalization of pressure in the refrigerant circuit can be likewise hastened, and hence a time required until the inside of the refrigerant circuit reaches an equalized pressure can be reduced.

Further, the control device 100 opens the electromagnetic valve 174 concurrently with the stop of the compressor 10 in order to release the bypass circuit in this embodiment, but the present invention is not restricted thereto, and the control device 100 may open the valve device in a period immediately before the stop of the compressor 10 and after the stop of the same.

Furthermore, the control device 100 may open the electromagnetic valve 174 after a predetermined period from the stop of the compressor 10, e.g., in a period after the compressor 10 is stopped and before the pressure in the sealed container 12 reaches a critical point. In this case, equalization of pressure in the refrigerant circuit can be likewise hastened, and a design pressure of the compressor 10 can be suppressed.

Moreover, although the control device 100 closes the electromagnetic valve 174 concurrently with the activation of the compressor 10, but the present invention is not restricted thereto, and it may close the electromagnetic valve 174 when equalization of pressure in the refrigerant circuit is completed.

Additionally, although the compressor 10 has been described by taking the internal intermediate-pressure multistage (two-stage) compression type rotary compressor as an example in the embodiment, the compressor 10 which can be used in the present invention is not restricted thereto, and the present invention is effective if the compressor 10 can turns the pressure in the sealed container including two or more compression elements into an intermediate pressure.

As described above, according to the refrigerant cycle apparatus of the present invention, the apparatus comprises the bypass circuit which causes the intermediate-pressure area to communicate with the low-pressure side of the refrigerant circuit or causes the high-pressure side to communicate with the intermediate-pressure area, the valve device provided to this bypass circuit and the control device which controls opening/closing of this valve device, and the control device constantly closes the valve device but opens it in order to release the flow path of the bypass circuit when the compressor is stopped. Therefore, like, e.g., claims 2 and 4, by setting the control device to open the valve device concurrently with the stop of the compressor, or in a period immediately before the stop of the compressor and after the stop of the same or after a predetermined period from the stop of the compressor, equalization of pressure of the intermediate-pressure area and the low-pressure side in the refrigerant circuit can be hastened after the compressor is stopped.

As a result, a time required until the inside of the refrigerant circuit reaches an equalized pressure can be greatly reduced, thereby improving the startability at the time of restart after the stop.

Further, by setting the control device to open the valve device concurrently with the stop of the compressor or in a period immediately before the stop of the compressor and after the stop of the same, the pressures in the refrigerant circuit can be turned into an equilibrium pressure on an earlier stage, thereby improving the startability.

On the other hand, by setting the control device to open the valve device after a predetermined period from the stop of the compressor, a design pressure in the sealed container can be suppressed, thus reducing a manufacturing cost.

In particular, when carbon dioxide is used as the refrigerant, each of the above-described inventions is more effective and can contribute to environmental problems.

What is claimed is:

1. A refrigerant cycle apparatus in which a refrigerant circuit is constituted by sequentially connecting a compressor, a gas cooler, throttling means and an evaporator, the compressor including first and second compression elements which are driven by a drive element, sucking a refrigerant into the first compression element from a low-pressure side of the refrigerant circuit and compressing it, discharging it into a sealed container, sucking the refrigerant with an intermediate pressure in the sealed container into the second compression element, compressing it and discharging it to a high-pressure side of the refrigerant circuit, the refrigerant cycle apparatus comprising:

a bypass circuit which causes an intermediate-pressure area to communicate with a low-pressure side of the refrigerant circuit or causes a high-pressure side to communicate with the intermediate-pressure area;

a valve device provided to the bypass circuit; and a control device which controls opening/closing of the valve device, wherein the control device constantly closes the valve device but opens it in order to release a flow path of the bypass circuit when the compressor stops.

2. The refrigerant cycle apparatus according to claim 1, wherein the control device opens the valve device concurrently with the stop of the compressor.

3. The refrigerant cycle apparatus according to claim 1, wherein the control device opens the valve device in a period immediately before the stop of the compressor and after the stop of the same.

4. The refrigerant cycle apparatus according to claim 1, wherein the control device opens the valve device after a predetermined period from the stop of the compressor.

5. The refrigerant cycle apparatus according to claim 1, claim 2, claim 3 or claim 4, wherein carbon dioxide is used as the refrigerant.

* * * * *